US008069624B1

(12) United States Patent
Sorkin

(10) Patent No.: US 8,069,624 B1
(45) Date of Patent: Dec. 6, 2011

(54) POCKETFORMER ASSEMBLY FOR A POST-TENSION ANCHOR SYSTEM

(76) Inventor: Felix L. Sorkin, Stafford, TX (US)

( * ) Notice: Subject to any disclaimer, the term of this patent is extended or adjusted under 35 U.S.C. 154(b) by 190 days.

(21) Appl. No.: 11/874,135

(22) Filed: Oct. 17, 2007

(51) Int. Cl.
*E04C 5/08* (2006.01)

(52) U.S. Cl. ..... 52/223.13; 403/314; 403/367; 403/369; 403/374.1

(58) Field of Classification Search ..... 52/223.13, 52/230, 223.6; 403/314, 367, 369, 374.1, 403/368, 365; 24/122.6, 122.3, 459
See application file for complete search history.

(56) References Cited

U.S. PATENT DOCUMENTS

| | | | | |
|---|---|---|---|---|
| 3,844,697 | A | 10/1974 | Edwards | |
| 3,956,797 | A | 5/1976 | Brandestini | |
| 3,967,421 | A * | 7/1976 | Dufossez | 52/146 |
| 4,053,974 | A | 10/1977 | Howlett et al. | |
| 4,066,368 | A * | 1/1978 | Mastalski et al. | 403/211 |
| 4,121,395 | A * | 10/1978 | Rudolf | 52/223.13 |
| 4,318,256 | A * | 3/1982 | Boonman | 52/223.13 |
| 4,363,462 | A * | 12/1982 | Wlodkowski et al. | 249/190 |
| 4,576,524 | A * | 3/1986 | Heintzmann et al. | 405/259.5 |
| 4,821,474 | A * | 4/1989 | Rodriguez | 52/223.13 |
| 4,884,377 | A * | 12/1989 | Matt | 52/98 |
| 4,923,337 | A * | 5/1990 | Huard | 405/224 |
| 4,928,451 | A * | 5/1990 | Reigstad et al. | 52/223.13 |
| RE34,350 | E * | 8/1993 | Dufossez | 52/146 |
| 5,261,198 | A * | 11/1993 | McMillan | 52/127.12 |
| 5,436,425 | A | 7/1995 | Sorkin | |
| 5,897,102 | A | 4/1999 | Sorkin | |
| 6,170,209 | B1 * | 1/2001 | Dagher et al. | 52/223.1 |
| 6,176,051 | B1 * | 1/2001 | Sorkin | 52/223.13 |
| 6,234,709 | B1 * | 5/2001 | Sorkin | 403/374.1 |
| 6,354,596 | B1 * | 3/2002 | Rodriguez | 277/317 |
| 6,380,508 | B1 * | 4/2002 | Sorkin | 219/121.39 |
| 6,381,912 | B1 * | 5/2002 | Sorkin | 52/223.13 |
| 6,393,781 | B1 | 5/2002 | Sorkin | |
| 6,470,636 | B1 * | 10/2002 | Rose | 52/223.1 |
| 6,513,287 | B1 * | 2/2003 | Sorkin | 52/223.13 |
| 6,748,708 | B1 * | 6/2004 | Fuzier et al. | 52/223.13 |
| 6,761,002 | B1 * | 7/2004 | Sorkin | 52/223.13 |
| 6,817,148 | B1 * | 11/2004 | Sorkin | 52/223.13 |
| 6,843,031 | B1 * | 1/2005 | Sorkin | 52/223.13 |
| 6,988,340 | B2 * | 1/2006 | Paulshus et al. | 52/223.1 |
| 7,216,842 | B2 * | 5/2007 | Watson | 249/177 |
| 2002/0078643 | A1 * | 6/2002 | Belbeoc'h | 52/223.13 |

(Continued)

OTHER PUBLICATIONS

U.S. Appl. No. 09/317,097, filed May 23, 1999.

*Primary Examiner* — Eileen D Lillis
*Assistant Examiner* — James Ference
(74) *Attorney, Agent, or Firm* — Egbert Law Offices PLLC

(57) ABSTRACT

A pocketformer apparatus for post-tension construction has an anchor member with an interior passageway, a tubular member extending into the interior passageway, a cup member with an interior opening in which the tubular member extends through the interior opening, and a securement member affixed adjacent the opposite end of the tubular member from the anchor body. The interior passageway has a threaded portion. The tubular member has a first end retained in the threaded portion. The tubular member has the second end extending outwardly of a side of the anchor body opposite the threaded portion. The cup member is interposed between the securement member and the anchor member. A form board is interposed between the cup member and the securement member. The threaded portion is an internal thread formed on an non-tapered portion of the interior passageway.

8 Claims, 4 Drawing Sheets

U.S. PATENT DOCUMENTS

2002/0083659 A1* 7/2002 Sorkin ..... 52/167.1
2002/0108329 A1* 8/2002 Bournand et al. ..... 52/223.13
2004/0148882 A1* 8/2004 Hayes ..... 52/223.14
2005/0034392 A1* 2/2005 Nuetzel et al. ..... 52/223.1
2006/0201083 A1* 9/2006 Hayes et al. ..... 52/223.13
2006/0236620 A1* 10/2006 LaCrosse ..... 52/155

* cited by examiner

POCKETFORMER ASSEMBLY FOR A POST-TENSION ANCHOR SYSTEM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post tension anchor systems. More particularly, the present invention relates to pocketformers that are used for the creation of a pocket in concrete adjacent to the end of a tendon in the anchor system. Additionally, the present invention relates to devices for securing the pocketformer in place.

2. Description of Related Art Including Information Disclosed Under 37 CFR 1.97 and 37 CFR 1.98.

For many years, the design of concrete structures imitated typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as 100 feet can be attained in members as deep as three feet for roof loads. The basic principal is simple. In prestressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Prestressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

In such post-tension construction, the tendons are anchored and cut off just inside the face of the structure in what are termed "pockets." The "pockets" surrounding the tendon end are filled with a concrete grout. A "pocketformer" is placed in the concrete adjacent to the face of the structure and against an end of the terminal anchor. After the concrete is suitably hardened, a form board is removed and the pocketformer is removed so as to expose the pocket. The ends of the tendon extend outwardly of the pocket. After the tensioning has occurred, the pocket is then filled with a concrete grout so as to be flush with the face of the structure.

Typical pocketformers as used in the prior art have a frustoconical surface on the exterior of the pocketformer. The frustoconical shape defines the pocket. A central tubular member is formed within the interior of the frustoconical portion. One end of the tubular member extends into the central bore of the anchor. The interior of the tubular member allows the tendon to extend therethrough. The tubular member is generally centered within the interior of the frustoconical portion. The surface of the anchor will abut the narrow end of the frustoconical portion. The wide end of the frustoconical portion will abut a surface of a form board. The tubular member extends through a hole in the form board. As such, the tendon will extend outwardly of the form board during the formation of the concrete structure.

One of the problems with the prior art pocketformer is the inability to properly secure the anchor relative to the pocketformer. In conventional practice, long threaded members will extend through holes in the anchor member and be attached to the form board. After the concrete is hardened, it will be necessary to remove the threaded members or nails. If these items are not removed, then corrosion can occur and rust patterns will form on the facing surface of the concrete structure. Furthermore, the use of nails or threaded members for securing the anchor relative to the form board is a time consuming and labor-intensive operation. As such, a need has developed so as to allow the anchor to be removably secured to the pocketformer during the installation of the pocketformer.

In the past, various patents have issued relating to pocketformers that serve to retain the anchor in place, against the form board, during the installation of the anchor. For example, U.S. Pat. No. 3,844,697, issued on Oct. 29, 1974 to H. J. W. Edwards, describes an anchorage assembly including an anchor having a hollow housing and a means therein for engaging a stressing tendon passing therethrough. The hollow member is removably attached to the anchor housing and to the concrete formwork and fixing the relative position of the anchor housing to the formwork. The member surrounds the tendon between the anchor housing and the formwork and is adapted and arranged to be detached from the anchor housing after the concrete has set. A cavity forming spacer is provided which surrounds the member and is disposed between and seals against the anchor housing and the formwork to form a cavity in the concrete.

U.S. Pat. No. 3,956,797, issued on May 18, 1976 to Brandestini, describes a pocketformer apparatus in which the pocketformer is initially threaded into the interior opening of a steel anchor. As such, the steel anchor will have internal threads which threadedly receive the external threads on the end of the pocketformer. The pocketformer includes an interior bore through which the tendon passes. On the opposite end of the pocketformer is a threaded section which extends on an opposite side of the form board from the anchor. A threaded nut is threadedly received by the threads of the pocketformer which extend on the opposite side of the form board.

U.S. Pat. No. 4,053,974, issued on Oct. 18, 1977 to Howlett et al., describes a method of forming a concrete structure with a recess to receive an anchorage. This method includes a tubular mounting means mounted to extend over the tendon and through an opening in a bearing or anchor plate in order to secure the bearing plate in a fixed position aligned in relation to the tendon for casting the bearing plate into the concrete member in a predetermined orientation. A spacing means is provided between the form board and the anchor plate so as to allow the anchor plate to be cast into a recess in the concrete member.

U.S. Pat. No. 4,363,462, issued on Dec. 14, 1982 to Wlodkowski et al., teaches a formwork for a concrete structural member. This device includes a recoverable formwork part. The recoverable part has an axially elongated sheath which closely encloses a tendon. A cup-shaped part is formed integrally with the sheath and is arranged to form at least a portion of the recess in the concrete member. When assembled on the formwork, one end of the sheath is arranged to be located within the concrete when it is poured and the other end is located on the exterior of the formwork. The cup-shaped part is located intermediate of the ends of the sheath and just inside the formwork. A member is engageable with the sheath for attaching it to the formwork.

U.S. Pat. No. 5,897,102, issued on Apr. 27, 1999 to the present inventor, describes a pocketformer apparatus for a post-tension anchor system. This pocketformer apparatus includes a tubular member with an outwardly flanged end, a securement member affixed to the tubular member, and a cup member having an interior opening such that the tubular member extends through the interior opening. The tubular member has an interior passageway extending from the flanged end to another end. The flanged end engages an anchor of the post-tension anchor system. The cup member is interposed between the flanged end and the securement member on the tubular member. The tubular member has an externally threaded area extending inwardly of the end opposite the flanged end. The securement member is threadedly received by the externally threaded area. An annular ring is formed on the flanged end of the tubular member so as to engage a receptacle formed in the encapsulation of the anchor. The securement member, the cup member and the tubular member are formed of a polymeric material.

Although the system described in U.S. Pat. No. 5,897,102 has performed well in actual usage, the system described in this patent is particularly adapted for use in association with an encapulated anchor. In particular, the flanged end of the tubular member engages the cap-receiving opening at the end of the encapsulation of the anchor member. In certain circumstances, certain construction requirements specify the use of a unencapsulated anchor. When such construction projects are specified, the system described in U.S. Pat. No. 5,897,102 cannot be adequately utilized. As such, a need has developed so as to provide a nailless pocketformer system whereby the system would accommodate unencapsulated anchorages.

U.S. Pat. No. 5,436,425, issued on Jul. 25, 1995 to the present inventor, describes a system whereby the tendon can be properly cut by using a plasma cutting torch. The present inventor is also the owner of U.S. application Ser. No. 09/317,097, filed on May 23, 1999, for another system for the cutting of a tendon used in post-tension anchor systems. These systems utilize a plasma cutting torch which utilizes a positioning element for interconnecting the head of a plasma cutting torch with a tendon to be severed. The pocket into which the plasma cutting torch and positioning element are inserted has a particular configuration so as to allow enough space for the apparatus. In actual use, the product described in this patent and this patent application has been very successful. As such, a need has existed for the use of such a plasma cutting torch in association with unencapsulated anchor systems.

The present inventor is identified as the inventor on a pair of patents dealing with such pocketformer apparatus. U.S. Pat. No. 5,897,102 issued on Apr. 27, 1999 to the present inventor, describes a pocketformer apparatus for a post-tension anchor system that has a tubular member with an outwardly flanged end, a securement member affixed to the tubular member, and a cup member having an interior opening such that the tubular member extends through the interior opening. The tubular member has an interior passageway extending from the flanged end to another end. The flanged end engages an anchor of the post-tension anchor system. The cup member is interposed between the flanged end and the securement member on the tubular member. The tubular member has an externally threaded area extending inwardly of the end opposite the flanged end. The securement member is threadedly received by the externally threaded area. An annular ring is formed on the flanged end of the tubular member so as to engage a receptacle formed on the anchor. The securement member, the cup member and the tubular member are formed of polymeric material.

U.S. Pat. No. 6,393,781, issued on May 28, 2002 to the present inventor, also describes a pocketformer apparatus for post-tension construction. This pocketformer apparatus has an anchor member having a wedge-receiving cavity therein, a tubular member having a portion extending through the wedge-receiving cavity, a first securement member affixed to a first end of the tubular member, a cup member positioned over the tubular member, and a second securement member affixed to a second end of the tubular member. The cup member is interposed between the second securement member and the anchor member. The tubular member also extends through a hole in a form board. The second securement member is positioned on one side of the form board. The cup member and the anchor member are positioned on an opposite side of the form board. A tendon extends through the tubular member.

One of the problems associated with each of these prior art patents is the requirement for various appliances that are required in order to create the assembly. In U.S. Pat. No. 6,393,781 a securement member located on a side of the anchor is required so as to engage with the threads on the tubular member. In circumstances in the field, this securement member can be lost or misplaced. As such, it can be difficult to install or misinstalled. Furthermore, this securement member must be threaded along the length of the tendon so as to be in a proper position for assembly. Often, the threads of the securement member are misaligned with the threads on the end of the tubular member that a proper positioning cannot be achieved. In the prior art, threads cannot be formed on the interior passageway on the anchor body since such threads could interfere with the proper seating of the wedge used to secure the tendon within the anchor. The internal cavity of the anchor was continuously tapered from one side of the anchor to the opposite side of the anchor. Any attempt to form threads on such a tapered surface would be ineffective. As such, it was not believed possible to install threads on the interior cavity of the anchor body.

It is an object of the present invention to provide a pocketformer system which allows the anchor to be properly secured in place relative to the form board.

It is another object of the present invention to provide a pocketformer system whereby an unencapsulated anchor can be properly positioned relative to the form board without the use of nails.

It is a further object of the present invention to provide a pocketformer system which eliminates the need for nails or threaded members for the attachment of the anchor relative to the form board.

It is still another object of the present invention to provide a pocketformer system which is easy to use, relatively inexpensive and easy to manufacture.

It is still another object of the present invention to provide a pocketformer system which minimizes the number of components required in order to create the pocket.

It is still another object of the present invention to provide a pocketformer system which allows the end of the tubular member to be directly engaged with the interior passageway of the anchor body so as to establish a direct fixed positioning of the anchor body relative to the pocketformer cup.

These and other objects and advantages of the present invention will become apparent from a reading of the attached specification and appended claims.

BRIEF SUMMARY OF THE INVENTION

The present invention is a pocketformer apparatus for post-tension construction. This pocketformer apparatus includes an anchor body having an interior passageway, a tubular member having a portion extending into the interior passageway, a cup member having an interior opening through which the tubular member extends, and a securement member affixed adjacent the end of the tubular member opposite the anchor body. The interior passageway of the anchor body has a threaded portion. The tubular member has a first end retained in the threaded portion of the interior passageway of the anchor body. The tubular member has a second end extending outwardly of the anchor body opposite the threaded portion. The cup member has a wide end and a narrow end. The cup member is interposed between securement member and the anchor member.

In the present invention, a tendon extends through the interior passageway of the anchor body and through the anchor body. The tubular member is interposed between the tendon and a wall of the interior passageway of the anchor body. This tubular member is also interposed between the tendon and a wall of the interior opening of the cup member. The tendon has a sheathing extending at least partially thereover.

The interior passageway of the anchor body has a tapered cavity extending inwardly from the side of the anchor body such that a wide end of the tapered cavity is at a side of the anchor body and a narrow end is at an opposite end of the tapered cavity. The anchor body also has a non-tapered portion extending from the narrow end of the tapered cavity to an opposite side of the anchor body. The threaded portion is formed on the non-tapered portion. The tubular member has a tapered outer diameter along a portion thereof. This tapered outer diameter extends along a wall of the tapered cavity of the interior passageway of the anchor body. The tubular member has an external thread formed at the first end thereof. The external thread is threadedly engaged with the threaded portion. The first end of the tubular member extends to the opposite side of the anchor body.

A form board is interposed between the cup member and the securement member. This form board has a hole formed therein. The tubular member extends through this hole. A narrow end of the cup member has positioning elements extending longitudinally outwardly therefrom transverse to a plane of an end surface at the narrow end. The anchor member is received between the positioning elements such that the interior passageway of the anchor body is in axial alignment with the interior opening of the cup member.

DETAILED DESCRIPTION OF THE INVENTION

Figure 1:
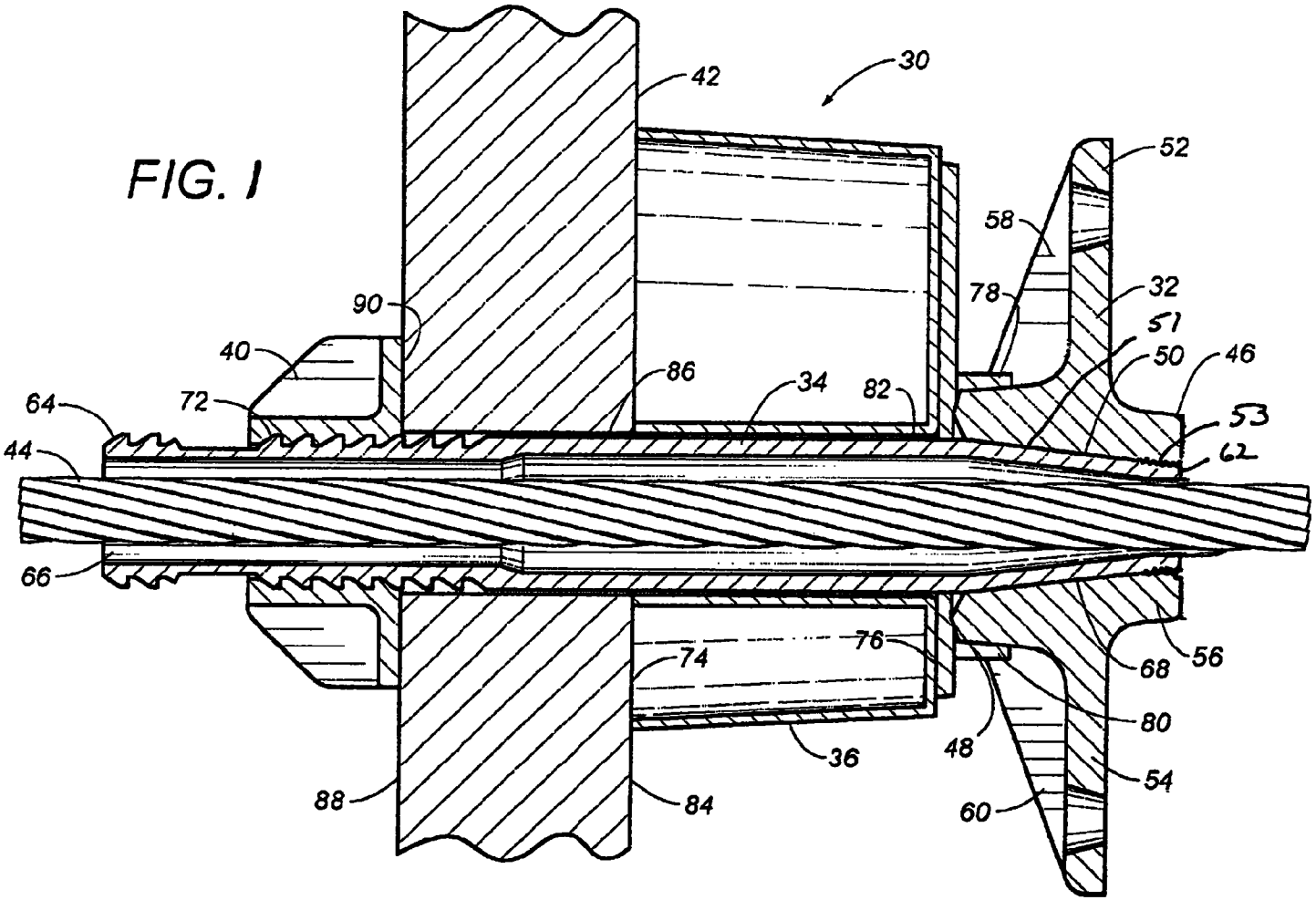
FIG. 1 is a cross-sectional side view of the pocketformer apparatus of the present invention.

Referring to FIG. 1, there is shown the pocketformer apparatus 30 as used in post-tension construction. The pocketformer apparatus 30 includes an anchor body 32, a tubular member 34, a cup member 36, a securement member 40, a form board 42 and a tendon 44. Each of these elements are assembled together so as to provide a particularly useful system for the formation of a pocket in post-tension construction. In the preferred embodiment of the present invention, the anchor body 32 is an unencapsulated steel anchor.

As can be seen in FIG. 1, the anchor body 32 has a side 48 and an opposite side 46. The anchor body 32 has an interior passageway 50 that extends through the interior of the anchor body 32. The interior passageway 50 includes a tapered cavity 51 and a non-tapered portion 53. The non-tapered portion 53 has internal threads formed thereon. The tapered cavity 51 has a wide end opening at the side 48 of anchor body 32 and a narrow end formed at an opposite end of the tapered cavity 51. The non-tapered portion 53 extends from the narrow end of the tapered cavity 51 to the opposite side 46 of the anchor body 32. The anchor body 32 has wings 52 and 54 extending outwardly from a central body portion 56. Gussets 58 and 60 extend from the central body portion 56 to the wings 52 and 54, respectively, for enhancing the strength of the anchor body 32.

Tubular member 34 has a first end 62 and an second end 64. An interior passageway 66 extends from the first end 62 to the opposite end 64. The tubular member 34 has a tapered portion 68 which is sized so as to conform with the tapered cavity 51 of the anchor body 32. The first end 62 is externally threaded such that the external threads at first end 62 of tubular member 34 engage with the internal threads 53 of the non-tapered portion of cavity 51. The first end 62 of the tubular member 34 terminates in alignment with the opposite side 46 of the anchor body 32. Threads 72 are formed at the second end 64 of the tubular member 34 so as to threadedly receive the securement member 40. The threads 72 can have a conventional threaded structure or can have a particularly unique threaded structure of the type shown previously in U.S. Pat. No. 6,383,781. The tendon 44 extends through the interior passageway 66 of the tubular member 34.

The cup member 36 is of a hollow construction. The cup member 36 has a wide end 74 and a narrow end 76. Positioning elements 78 and 80 extend outwardly of the narrow end 76 so as to allow the anchor body 32 to have its central body portion 56 received therebetween. The positioning elements 78 and 80 serve to position the anchor body 32 in such a way that the interior passageway 50 is axially aligned with the opening 82 of the cup member 36.

The cup member 36 is positioned so as to have its wide end 74 in surface-to-surface contact with the surface 84 of the form board 42. In the arrangement in accordance with the present invention, the cup member 36 will be sandwiched between the anchor body 32 and the surface 84 of the form board 42. The tubular member 34 will extend through the interior opening and through the hole 86 in the form board 42 such that its second end 64 will extend outwardly of the opposite side 88 of the form board 42.

The securement member 40 is positioned over the thread 72 at the second end 64 of the tubular member 34. This securement member 40 can be threadedly secured so as to have a surface 90 in surface-to-surface contact with the opposite side 88 of the form board 42. The securement member 40 can be suitably tightened on the threads 72 so as to establish a tight sandwiched relationship between the anchor body 32, the cup member 36, the form board 42 and the securement member 40. The engagement of the external threads at the first end 62 of the tubular member 34 with the internal threads on the non-tapered portion 53 of interior passageway 50 of anchor body 32 serves to fix each of these items in a tight sandwiched construction.

Unlike the prior art pocketformer systems described in the patents issued to the present inventor and described hereinbefore, the pocketformer apparatus 30 of the present invention does not require engagement with an encapsulation of the anchor member. The tubular member 34 is directly engaged with the threads of the non-tapered portion 53 of the interior passageway 50 of anchor body 32. This can be accomplished by simply rotating the tubular member 34 such that the threaded engagement will draw the first end 62 of tubular member 34 into its desired position adjacent to the opposite side 46 of anchor body 32. The "drawing in" of the first end 62 of tubular member 34 further serves to assure a tight sealing relationship between the outer surface of the tubular member 34 and the tapered cavity 51 of interior passageway 50. The tubular member 34 can easily be removed by rotating the tubular member 34 in an opposite direction. This "drawing in" of the first end 62 of tubular member 34 further serves to cause the interior surface of tapered portion 68 of tubular member 34 to be drawn into tight sealing contact with the exterior surface of the tendon 44. As such, the present invention accomplishes a proper seal so as to avoid any intrusion of concrete into the interior passageway 50 of anchor body 32.

Figure 2:
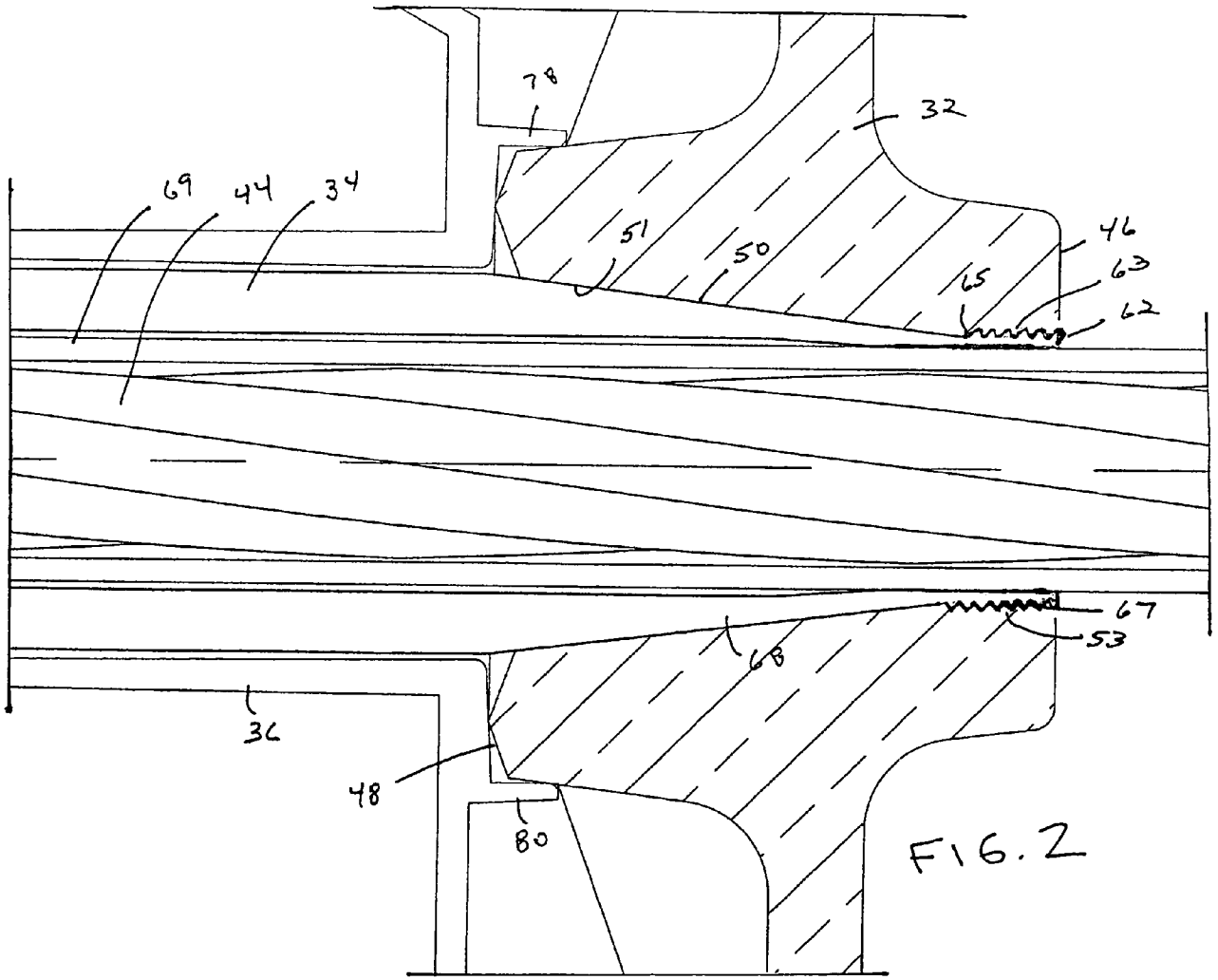
FIG. 2 is a detailed cross-sectional view showing the assembly of the tubular member with the anchor body and the pocketformer apparatus of the present invention.

FIG. 2 shows a detailed view of how the tubular member 34 has its first end 62 engaged with threads 63 formed at the opposite side 46 of anchor body 32. The anchor body 32 has its interior passageway 50 extending from side 48 to opposite side 46. The tapered cavity 51 has its wide end opening at the side 48 of anchor body 32. The narrow end 65 of the tapered cavity 51 is interior of the anchor body 32 and opposite to the wide end of the tapered cavity 51 at side 48 of anchor body 32. The non-tapered portion 53 extends from the narrow end 65 to the opposite side 46 of anchor body 32. Internal threads 63 are formed on this non-tapered portion 53. The tubular member 34 has external threads 67 formed at the first end 62. The external threads 67 engage the internal threads 63 of the anchor body 32. The tapered portion 68 of tubular member 34 resides in tight surface-to-surface contact with the wall of the tapered cavity 51 of the interior passageway 50. The tendon 44 extends through the interior of the tubular member 34. It can be seen that the tendon 44 includes a polymeric sheathing 69 extending thereover. Positioning elements 78 and 80 of the cup member 36 serve to receive the side 48 of anchor body 32 therein. As a result of this arrangement, the interior passageway 50 is longitudinally and axially aligned with the longitudinal axis of the tubular member 34.

Figure 3:
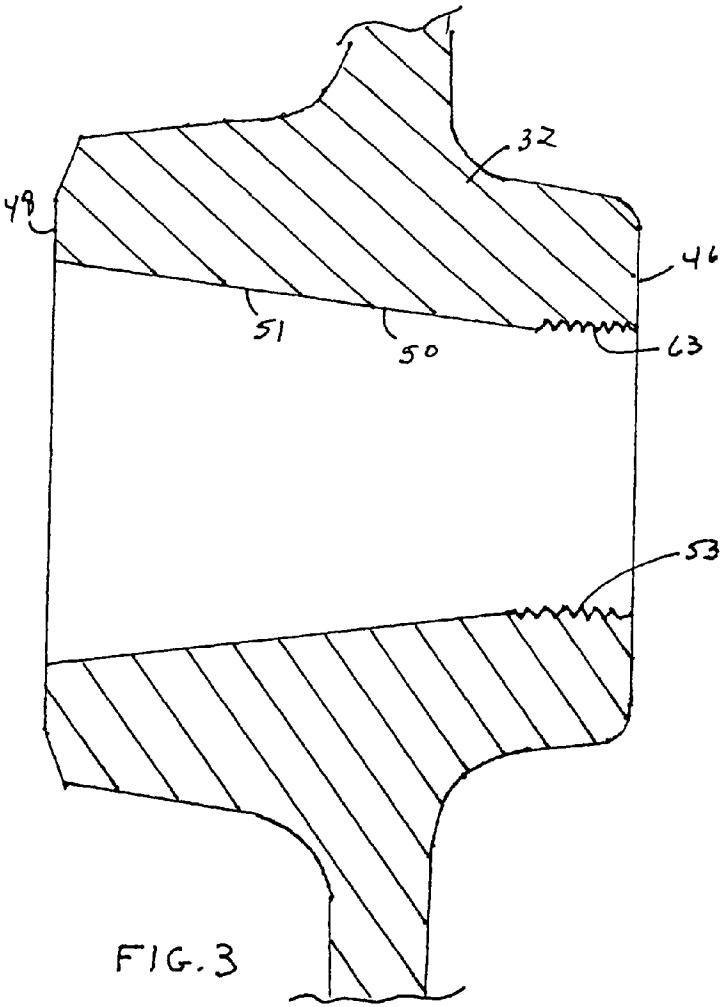
FIG. 3 is an isolated cross-sectional view of the anchor body as used in the pocketformer apparatus of the present invention.

FIG. 3 shows an isolated view of the anchor body 32. Anchor body 32 is a steel anchor having the interior passageway 50 formed therein. Interior passageway 50 includes the tapered cavity 51 and the non-tapered portion 53. Internal threads 63 are machined onto to non-tapered portion 53 by a thread-forming machine entering the interior passageway 50 from the opposite side 46 of anchor body 32. Since the non-tapered portion 53 has a relatively wide diameter, it is fairly simple to machine the threads 63 into the interior passageway 50. Unlike the prior art, the interior passageway 50 is not continuously tapered from opposite side 46 to side 48 of the anchor body 32. Also, the relatively wide diameter of the non-tapered portion 53 will cause a small clearance to exist between the outer surface of the tendon 44 and the threads 63. As such, the threaded end of the tubular member 34 can be introduced therebetween.

Figure 4:
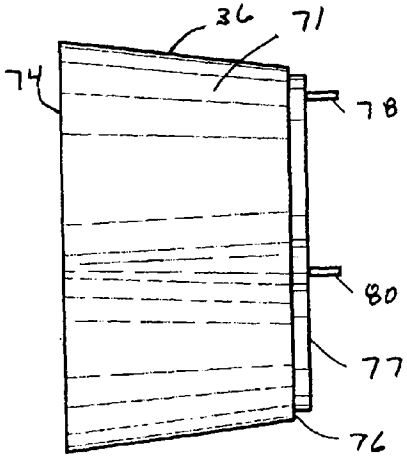
FIG. 4 is a side elevational view of the cup member as used in the pocketformer apparatus of the present invention.

FIG. 4 is a side view of the cup member 36. As can be seen, side 71 tapers inwardly from the wide end 74 to the narrow end 76. Positioning elements 78 and 80 are formed on the face 77 of the cup member 36. The cup member 36 can have a wide variety of shapes within the concept of the present invention. For example, the cup member 36 can be generally round or it can have a double oval shape so as to facilitate the use of a plasma torch in the formed concrete. The tapered narrow end 76 of the cup member 36 facilitates the ability to mold the cup member 36 in an injection molding processes. The angled side 71 of the cup member 36 also facilitates the ability to slidably remove the cup member 36 from the concrete after the concrete has solidified. The positioning elements 78 and 80 extend outwardly from face 77 so as to receive the side 48 of anchor body 32 therein such that the anchor body is in a desired position.

Figure 5:
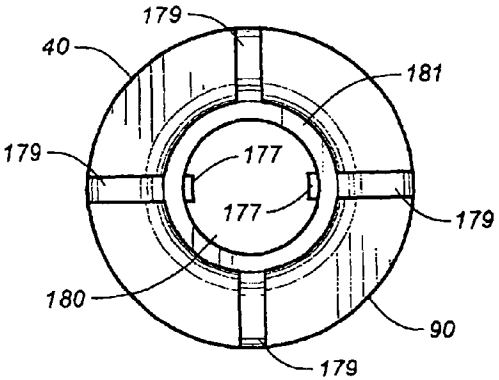
FIG. 5 is an end view of the securement member as used in the pocketformer apparatus of the present invention.

FIG. 5 shows an end view of the securement member 40. It can be seen that the securement member 40 includes internal threaded portions 177. The internal threaded portions 177 engage the external threaded portions 72 of the tubular member 34. Specifically, the threaded portions 177 have a length which will fit through a split formed on the external threaded portions 72 of the tubular member 34. The threaded portions 177 will have a thickness suitable for fitting between the threads 72 on the tubular member 34. The securement member 40 includes a flat abutment surface 90 which will be in surface-to-surface contact with the side 88 of the form board 42. Gussets 179 will extend from the forward face 181 of the securement member 40 to the flat abutment surface 90. As can be seen, the securement member 40 includes an interior bore 180 which will allow the securement member 40 to be placed over the exterior of the tubular member 34.

Figure 6:
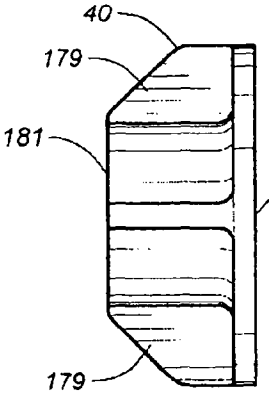
FIG. 6 is a side elevational view of the securement member as used in the pocketformer apparatus of the present invention.

FIG. 6 shows a side view of the securement member 40. In particular, it can be seen that the flat abutment surface 90 is formed at one end of the securement member 40. The forward face 181 is at the opposite end of the securement member 40. Gussets 179 extend from the forward face 181 to the flat abutment surface 90. The gussets 179 facilitate the ability to properly position the securement member 40 around the threaded portion 72 of the tubular member 34.

Figure 7:
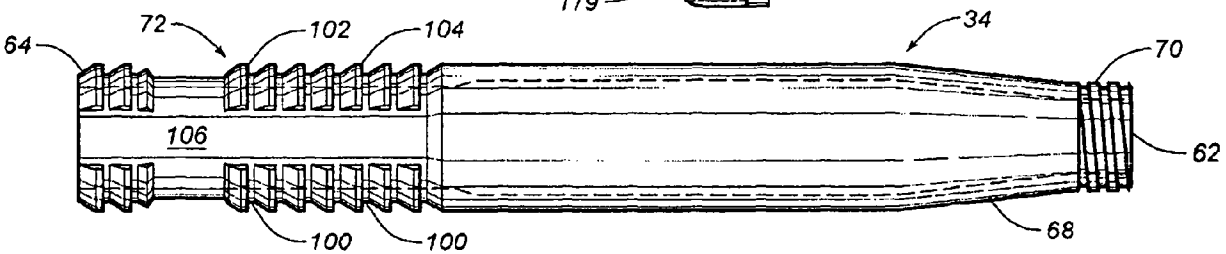
FIG. 7 is a isolated side elevational view of the tubular member as used in the pocketformer apparatus of the present invention.

FIG. 7 shows the configuration of one embodiment of the tubular member 34 as used in the present invention. As can be seen, the tubular member 34 has threads 70 at first end 62, a tapered portion 68, an external thread 72 formed at the second end 64 of the tubular member 34. These external threads 72 allow the securement member 40 to be affixed thereover. The threads have a special configuration of the type described previously in U.S. Pat. No. 6,393,781. As can be seen, the threads 72 are parallel threads which are formed on the tubular member 34. A space 100 occurs between adjacent threads 102 and 104. A split 106 is formed along the circumference of each of the threads. The split 106 extends for the length of the threaded sections 72 of the tubular member 34. The split 106 allows the threaded portion of the securement member 40 to slide easily along the length of the threaded sections 72 until the surface 90 resides against the form board 42. The securement member 40 can be rotated so that the threaded portion on the interior of the securement member 40 will reside between the adjacent threads. As such, it is not necessary to continually rotate the securement member 40 so as to draw it into contact with the form board 42. However, within the scope of the present invention, the threaded portion 72 can be of a conventional form, square threaded, or otherwise configured so as to allow the securement member 40 to be moved to its desired position.

Figure 8:
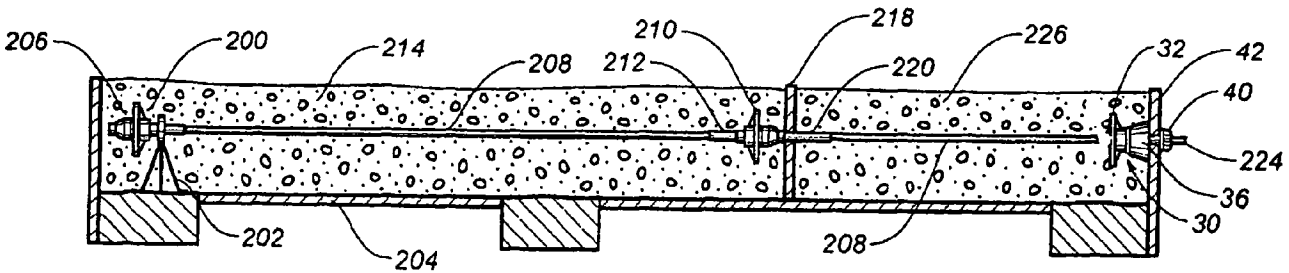
FIG. 8 is a diagrammatic illustration of the installation of the pocketformer apparatus of the present invention.

FIG. 8 shows a diagrammatic illustration of the installation of the pocketformer apparatus. Specifically, with respect to the installation of the present invention for the formation of a pocket in the concrete 226 adjacent to the form board 42, the end of the tubular member is inserted into the interior passageway 50 of the anchor body 32 and rotated such that the threads on the tubular member engage with the threads in the non-tapered portion 53 of the anchor body 32. Continued rotation draws the tapered member into its desired seating position within the interior passageway 50 of anchor body 32. A cup member 36 is positioned over the tubular member 34 such that a narrow end of the cup member 36 faces the side 48 of the anchor body 32. The tubular member 34 is extended through the hole 86 in the form board 42 such that a wide end 74 of the cup member 36 faces one side of the form board 42 and such that the second end 64 of the tubular member 34 extends outwardly of the opposite side 88 of the form board 42. The securement member 40 is placed over the second end 64 of the tubular member 34. The tendon 44 is then extended through the tubular member 34. Concrete 226 can then be poured over the exterior surface of the anchor body 32 and the cup member 36 within side 84 of the form board 42. The concrete then solidifies. Following the solidification of the concrete 226, the securement member 40 is removed from the second end 64 of the tubular member 34. The form board 42 and the cup member 36 are then removed from the tubular member 34 so as to expose a pocket which is shaped like the exterior surface of the cup member 36. The tubular member 34 can then be pulled from the interior passageway 50 of the anchor body 32. The tubular member 34 can then be rotated so as to threadedly disengage from the threads 63 on the non-tapered portion 53 of interior passageway 50. The tendon end 224 will then extend outwardly of this pocket. The tendon can then be severed, as desired.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A pocketformer apparatus for post-tension construction comprising:

a one piece anchor body having a cavity formed therein, said cavity defining an interior passageway through said anchor body, said cavity having a tapered portion with a wide diameter end at one side of said anchor body and a narrow diameter end inwardly therefrom, said cavity having a non-tapered portion extending from said narrow diameter end of said tapered portion to an opposite side of said anchor body, said non-tapered portion having threads formed thereon;

a tubular member having a portion extending into said cavity of said anchor body, said tubular member having threads formed at a first end thereof, said threads of said tubular member being only engaged with said threads of said non-tapered portion of said cavity, said first end of said tubular member extending only to said opposite side of said anchor body, said tubular member having a second end extending outwardly of said one side of said anchor body;

a cup member having an interior opening, said tubular member extending through said interior opening, said cup member having a wide end and an narrow end; and a securement member affixed adjacent said second end of said tubular member, said cup member interposed between said securement member and said anchor body.

2. The pocketformer apparatus of claim 1, further comprising:

a tendon extending through said interior passageway of said anchor body and through said tubular member.

3. The pocketformer apparatus of claim 2, said tubular member interposed between said tendon and a wall of said interior passageway of said anchor body, said tubular member interposed between said tendon and a wall of said interior opening of said cup member.

4. The pocketformer apparatus of claim 2, said tendon having a sheathing extending thereover.

5. The pocketformer apparatus of claim 1, said tubular member having a tapered outer diameter juxtaposed against a wall of said tapered portion of said cavity of said anchor body.

6. The pocketformer apparatus of claim 1, said threads of said tubular member being external threads, said external threads being threadedly engaged with said threads of said non-tapered portion of said cavity.

7. The pocketformer apparatus of claim 1, further comprising:

a form board interposed between said cup member and said securement member, said form board having a hole formed therein, said tubular member extending through said hole.

8. The pocketformer apparatus of claim 1, said narrow end of said cup member having positioning elements extending longitudinally outwardly therefrom transverse to a plane of an end surface at said narrow end, said anchor body received between said positioning elements such that said interior passageway of said anchor body is in axial alignment with said interior opening of said cup member.

* * * * *